US005509470A

United States Patent [19]

Bass

[11] Patent Number: 5,509,470

[45] Date of Patent: Apr. 23, 1996

[54] MOLDED OR CAST SHORT RADIUS RETURN BENDS FOR HORIZONTAL SHELL AND TUBE VESSEL

[75] Inventor: Gregory T. Bass, Clayton, N.C.

[73] Assignee: Morris & Associates, Garner, N.C.

[21] Appl. No.: 221,599

[22] Filed: Apr. 1, 1994

[51] Int. Cl.[6] ..... F28F 9/26

[52] U.S. Cl. ..... 165/158; 165/11.1; 165/DIG. 439

[58] Field of Search ..... 165/11.1, 150, 165/158; 220/319, 327

[56] References Cited

U.S. PATENT DOCUMENTS

| | | | |
|---|---|---|---|
| 1,875,663 | 9/1932 | Sandstrom | 165/158 X |
| 1,900,627 | 3/1933 | Willoughby | 220/327 |
| 1,912,769 | 6/1933 | Hansell | 165/11.1 |
| 1,940,963 | 12/1933 | McIntyre | 165/150 X |
| 2,420,318 | 5/1947 | Leonard et al. | 220/327 X |
| 4,340,400 | 7/1982 | Campanile et al. | 55/269 |
| 4,474,011 | 10/1984 | Nelson et al. | 60/648 |

FOREIGN PATENT DOCUMENTS

| | | | |
|---|---|---|---|
| 288821 | 11/1915 | Germany | 165/158 |

*Primary Examiner*—Allen J. Flanigan

*Attorney, Agent, or Firm*—Popham, Haik, Schnobrich & Kaufman, Ltd.

[57] ABSTRACT

A U-shaped tube end connector for use on a horizontal shell and tube heat exchanger with the U-shaped tube end connector having close centerline-to-centerline capability and being molded from transparent plastic or cast stainless steel with built in O-ring type sealing gasket that eliminates the need for cumbersome space consuming special clamps by allowing for the bolting of the molded U-shaped tube end connector directly onto the face of a tube sheet on the heat exchanger vessel.

2 Claims, 2 Drawing Sheets

MOLDED OR CAST SHORT RADIUS RETURN BENDS FOR HORIZONTAL SHELL AND TUBE VESSEL

BACKGROUND OF THE INVENTION

1. Field of the Invention

The present invention relates to an improved fluid connector. More specifically, the invention relates to a molded or cast short radius return bend for use on horizontal shell and tube heat exchangers.

2. Related Art

U.S. Pat. No. 3,635,040 shows a shell and tube water chiller using a compartmentalized chamber at each end of a vessel with suitable partitions or baffles to direct the water flow through the tubes sequentially in series to achieve the desired cooling. The water chiller shown in U.S. Pat. No. 3,635,040 includes a heavy duty hinged stainless steel door for closing off the compartments at each end of the vessel during operation, and for allowing access for inspection and cleaning as required.

In order to maximize the cooling capacity of water chillers such as that shown in U.S. Pat. No. 3,635,040, it is desirable to maximize the water flow rate through the tubes of the water chiller. A large amount of pumping horse power is consumed by the prior art chillers in order to overcome the resistance to fluid flow occurring at each end compartment of the chiller as flow is directed from tube to tube in sequence by each rectangular end compartment.

The provision of stainless steel doors at each end of the vessel shown in U.S. Pat. No. 3,635,040 increases the complexity of fabrication of the vessel as well as its overall size. The compartmentalized chambers at each end of the prior art vessel for directing water flow through the tubes sequentially in series allows for spacing of 3 inch diameter tubes at approximately 4 inches from centerline-to-centerline, thereby allowing for a relatively compact vessel. However, an inherent disadvantage of using such compartments for directing flow from one tube to another is the relatively large pressure drop that occurs through the compartments.

The resistance to flow in a piping system is similar to the resistance of an object immersed in a flow stream and is made up of pressure (inertia) or shape drag and skin-friction (viscous) drag. For piping components such as bends and elbows, pressure drag is predominant. For bends and elbows, the loss is made up of pressure drag due to the change of direction of the flow and the creation of secondary flows in the component. One parameter used to describe the resistance to flow for piping components is the equivalent length of pipe expressed in terms of pipe diameters needed downstream of the component to dissipate the secondary flows generated by the components. A smooth surface in a flow component generates fewer secondary flows as fluids pass through the component than a surface with sharp transitions. As a result, a U-shaped flow component will have a smaller "equivalent length" than a rectangular-shaped flow component and will cause less of a pressure drop in fluid passing through the component. The power consumed by a pump in order to maintain a desired flow rate through a piping system increases in proportion to the pressure drop through the piping system. Therefore, the use of piping components with smaller "equivalent lengths" minimizes the required pumping horse power and energy consumption for the piping system.

Existing standard stainless steel U-bends for 3 inch tubes in a typical water chiller such as shown in U.S. Pat. No. 3,635,040, require a centerline-to-centerline distance of 9 inches. Increasing the centerline-to-centerline distance to 9 inches from the 4 inch distance in U.S. Pat. No. 3,635,040 would require the shell diameter of the vessel to be increased from 26 inches to 36 inches to accommodate the same number of tubes on 9 inch centerline-to-centerline, which would greatly increase the size, weight, shell thickness and cost of the vessel.

In addition, since the U-bend must be removable for sanitation inspection as required by the U.S.D.A. when the heat exchanger is used for food processing, the design must allow use of clamps or some other means to accommodate U-bend removal. No existing clamps on the market today are adapted for such close centerline-to-centerline designs.

Attempts to fabricate close centerline U-bends by fabricating square U-bends utilizing 45° miter joints and 3 inch stainless steel pipes have the inherent disadvantage in that the U-bends cannot be ground and polished inside after welding and do not meet U.S.D.A. sanitation standards. The square corners within such fabricated fittings also result in a greater pressure drop through the fitting than produced in a fitting having a smooth U-shape configuration.

SUMMARY OF THE INVENTION

An object of the present invention is to provide a fluid fitting for accomplishing a minimum centerline-to-centerline connection between tubes in a vessel to achieve minimum pressure drop in the fluid being circulated, while allowing for easy and thorough clean up using clean-in-place technology, and providing for quick and easy removal of the fluid fittings for inspection and manual cleaning as required. In a preferred embodiment of the present invention a heat exchanger is shown having an elongated shell surrounding an axial cavity, a plurality of tubes contained within the axial cavity, tube sheets connected to the elongated shell at each of its ends and having a plurality of apertures for receiving the ends of the tubes, and a plurality of substantially U-shaped tube end connectors each having a U-shaped portion and a rim portion connected to the U-shaped portion and surrounding an opening to a chamber defined within the U-shaped portion. The tube end connectors are mounted to the tube sheets with their openings facing and overlapping two of the apertures and with each of the openings having a width approximately equal to the diameter of a single aperture and a length approximately equal to the diameter of a single aperture plus the centerline-to-centerline distance between the apertures. The tube end connectors are provided with gasket grooves along the rim portions for supporting sealing gaskets that eliminate the need for cumbersome space consuming special clamps by allowing the U-shaped tube end connectors to be bolted directly to a face of the tube sheet. The U-shaped configuration of this tube end connector provides the advantage of reduced pressure drop while allowing for a close centerline-to-centerline spacing of the tubes in the heat exchanger. A further advantage of ease of assembly and disassembly is realized by the provision of a gasket groove integral with the rim portion of the tube end connector as well as the provision of integral lugs and/or the provision of a special clamp that mates with a shoulder portion of the tube end connector rim portion. The tube end connectors can be fabricated from a variety of materials including molded plastic, cast stainless steel or forged steel. An additional advantage obtained by the provision of transparent molded plastic for the material making up the tube end connector, is the ease of visual inspection for cleanliness of the tube fittings and the tubes.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which.

DETAILED DESCRIPTION OF THE PREFERRED EMBODIMENTS

Figure 1:
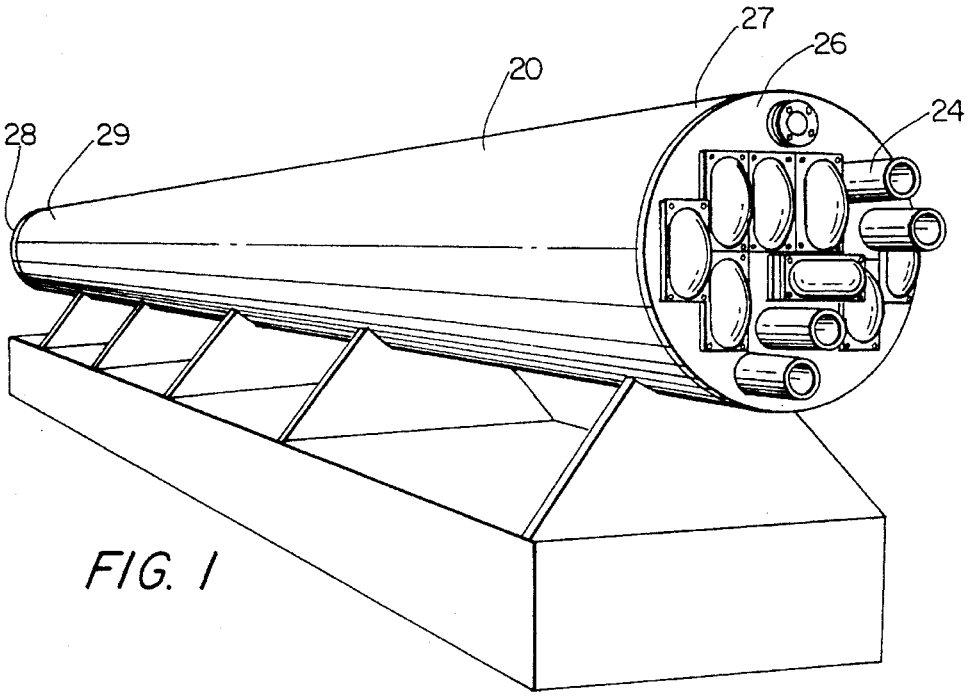
FIG. 1 is a perspective view of a horizontal shell and tube heat exchanger having U-shaped tube end connectors.

In describing preferred embodiments of the present invention illustrated in the drawings, specific terminology is employed for the sake of clarity. However, the invention is not intended to be limited to the specific terminology so selected, and it is to be understood that each specific element includes all technical equivalents which operate in a similar manner to accomplish a similar purpose.

A horizontal shell and tube heat exchanger is shown in FIG. 1 having an outer elongated substantially cylindrical shell 20 which surrounds a cavity 22 within which a plurality of tubes 24 are provided. A first tube sheet 26 is attached to the first end 27 of shell 20, and a second tube sheet 28 is attached to the second end 29 of shell 20. Tube sheets 26 and 28 define the ends of cavity 22 and are provided with a plurality of apertures 30 which are diminished to fit snugly around the outer diameter of the ends of tubes 24. Tube sheets 26 and 28 with apertures 30, maintain tubes 24 in substantially parallel spaced relationship within cavity 22.

Figure 6:
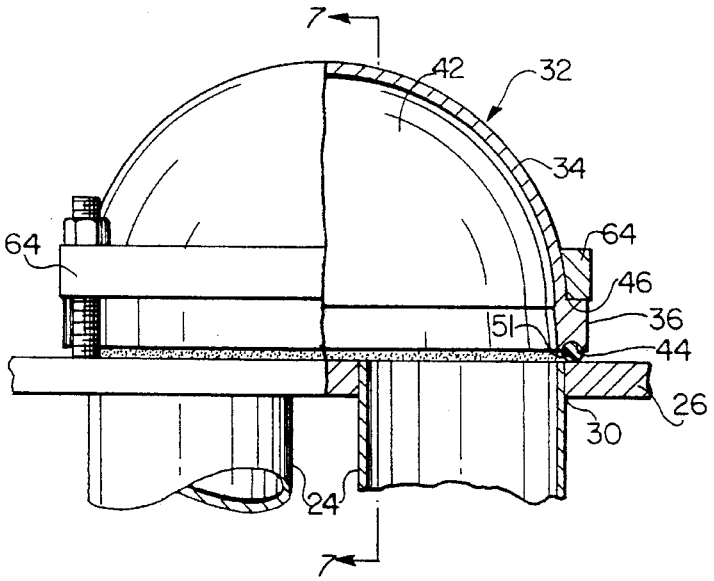
FIG. 6 is a cross sectional view taken along line 6—6 in FIG. 5, showing the U-shaped tube end connector attached to the tube sheet in position over the ends of two adjacent tubes.

In one embodiment, tubes 24 are 3 inches in diameter and are spaced with a centerline-to-centerline distance of approximately 4 inches. In order to provide for series flow from one tube to another in the shell and tube heat exchanger, U-shaped tube end connectors 32 are provided for attachment to tube sheets 26 and 28 in positions that overlap the open ends of two adjacent tubes 24, as shown in FIG. 6. Tube end connectors 32 each have a U-shaped portion 34 and a rim portion 36.

Figure 5:
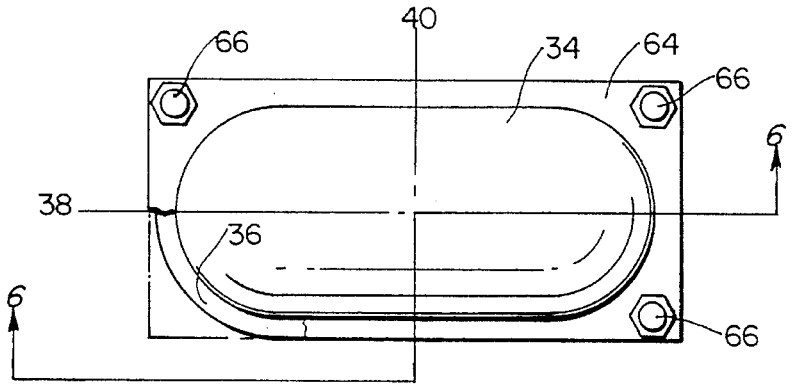
FIG. 5 is a side elevation view, partially in section, of the U-shaped tube end connector attached by a special clamp to the tube sheet.

Referring to FIG. 5, each tube end connector 32 has a substantially U-shaped cross section in a first longitudinal plane 38 bisecting tube end connector 32. Tube end connectors 32 also have a substantially U-shaped cross section in a second transverse plane 40 perpendicular to plane 38 and also bisecting tube end connector 32. When positioned over the ends of tubes 24 to be connected in series, longitudinal plane 38 of tube end connector 32 intersects the central axes of tubes 24. The length of a tube end connector 32 along longitudinal plane 38 is approximately equal to the diameter of tube 24 plus the desired centerline-to-centerline spacing of the tubes 24 to be connected in series by tube end connector 32. The width of a tube end connector 32 along transverse plane 40 is approximately equal to the diameter of tube 24.

As shown in FIG. 6, U-shaped portion 34 of tube end connector 32 has a substantially constant wall thickness and bounds a chamber 42 which fills with fluid when the heat exchanger is in operation. Rim portion 36 has a greater wall thickness than U-shaped portion 34 and extends from U-shaped portion 34 to a sealing surface 44. Rim portion 36 extends outwardly from U-shaped portion 34 to form a shoulder 46 opposite from rim sealing surface 44.

A gasket groove 50 is formed into the rim sealing surface 44 of rim portion 36 along its entire length. In a preferred embodiment, gasket groove 50 is semi-spherical in shape and is designed to support an O-ring type seal. Rim portion 36 along with gasket groove 50 and rim shoulder 46 can be molded, cast or forged as one piece with U-shaped portion 34 depending on what material tube end connector 32 is made from.

Figure 2:
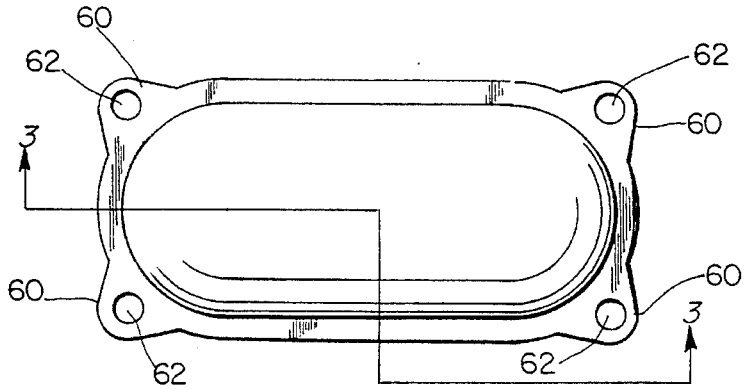
FIG. 2 is a top plan view of the U-shaped tube end connector.
Figure 3:
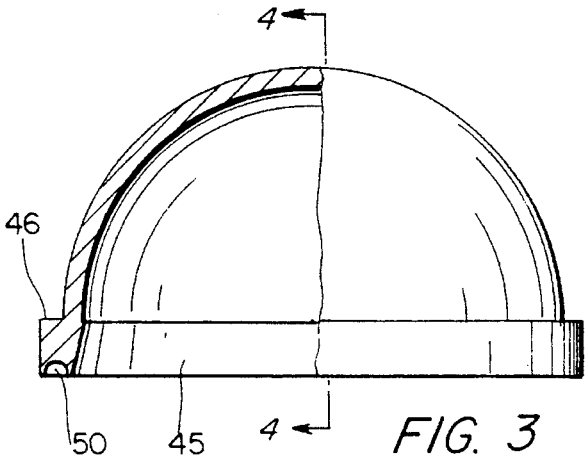
FIG. 3 is a side elevation view, partially in section, taken along line 3—3 in FIG. 2.
Figure 4:
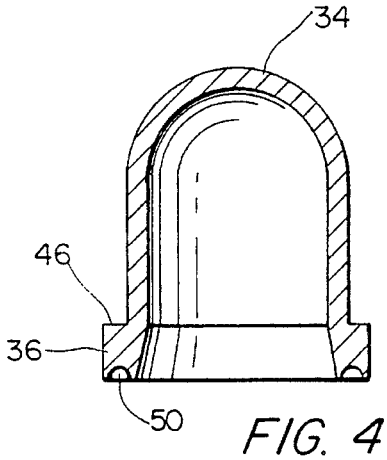
FIG. 4 is a cross sectional view taken along line 4—4 in FIG. 3.

In one embodiment shown in FIG. 2, laterally extending lugs 60 can also be formed as one piece along with rim portion 36 and U-shaped portion 34 of tube end connector 32. Lugs 60 are provided with through holes 62 for allowing the passage of fastening means such as socket head cap screws, to be used to connect tube end connector 32 to a respective tube sheet 26 or 28.

In a second embodiment shown in FIG. 5 and 6, connection of tube end connector 32 to a respective tube sheet 26 or 28 is achieved by the use of a special clamp 64 that has an inner periphery that fits snugly around the outer periphery of U-shaped portion 34 at the point where U-shaped portion 34 meets rim portion 36. Clamp 64 is substantially rectangular in shape and therefore extends radially outwardly past the outer periphery of curved rim shoulder 46 at each of the four corners of clamp 64 when clamp 64 is resting on rim shoulder 46. Holes 66 at each of the four corners of clamp 64 allow for the passage of fastening means such as threaded studs, as shown in FIG. 6, extending perpendicular to tube sheets 26 and 28, and thereby provide a means for tightening tube end connector 32 down on to an associated tube sheet 26 or 28.

Figure 7:
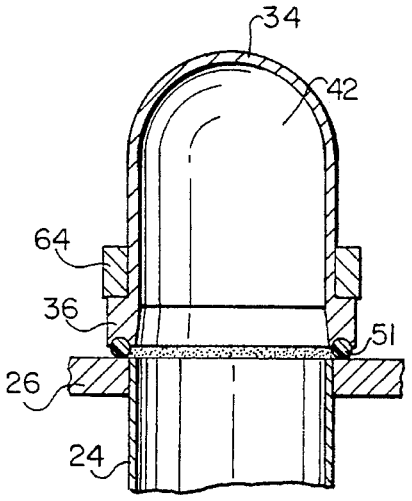
FIG. 7 is a cross sectional view taken along line 7—7 in FIG. 6.

Clamp 64 or lugs 60 provide a quick and efficient means for attaching and removing tube end connectors 32 from their associated tube sheets 26 or 28. When tightened onto an associated tube sheet, tube end connector 32 provides a series flow connection between two adjacent tubes 24. As shown in FIGS. 6 and 7, a gasket 51 supported in gasket grove 50 provides a seal around the outer periphery of the ends of two adjacent tubes 24 to be connected in series. Gasket 51 contacts tube sheet 26 or 28 along an oblong path having a width slightly greater than the diameter of a tube 24 and a length slightly greater than the diameter of a tube 24 plus the centerline-to-centerline distance between two adjacent tubes 24. The four corners of this oblong path each have a radius approximately equal to the radius of a tube 24.

Tube end connectors 32 can be molded as a single piece including U-shaped portion 34, rim portion 36 and gasket groove 50, from a plastic material, or can be cast from stainless steel or other metals. An advantage provided by the use of a clear plastic material for tube end connector 32 is the added ease of inspection. The inner periphery of rim portion 36 can be bevelled radially outwardly towards rim sealing surface 44 in order to insure a smooth transition from the opening 45 into chamber 42. The entire inner periphery of U-shaped portion 34 and rim portion 36 can be easily polished to meet U.S.D.A. sanitation standards and to reduce the resistance to flow through tube end connector 32.

As an alternative embodiment, several U-shaped tube end connectors 32 can be molded or cast together as a single piece. The provision of lugs 60 integral with rim portion 36 of tube end connector 32, or special clamp 64 that fits snugly over rim shoulder 46 along with integral gasket groove 50 and gasket 51 enables a compact and efficient assembly to tube sheets 26 or 28 without the need for special bulky clamps that would interfere with the desired close centerline-to-centerline spacing of tubes 24.

Modifications and variations of the above-described embodiments of the present invention are possible, as appreciated by those skilled in the art in light of the above teachings. For example, a wide variety of materials and processes can be used to form the U-shaped tube end connectors. Furthermore, the U-shaped tube end connector can be designed to accommodate a wide variety of tube diameters and centerline-to-centerline dimensions.

It is therefore to be understood that, within the scope of the appended claims and their equivalents, the invention may be practiced otherwise than as specifically described.

What is claimed is:

1. A heat exchanger comprising:

an elongated shell surrounding an axial cavity with said elongated shell having first and second ends;

a plurality of tubes contained within said axial cavity with each of said tubes having first and second tube ends;

first and second tube sheets connected to said elongated shell at said first and second ends, respectively, and each having a plurality of apertures of predetermined diameter therethrough for receiving said first and second tube ends spaced apart at a predetermined centerline-to-centerline distance; and a plurality of substantially U-shaped tube end connectors each having a U-shaped portion and a rim portion connected to said U-shaped portion and surrounding an opening to a chamber defined within said U-shaped portion, wherein each of said tube end connectors is demountably fastened to an associated tube sheet with said opening facing and overlapping two of said apertures and having a width approximately equal to said predetermined diameter of said apertures and a length approximately equal to said predetermined diameter of said apertures plus said predetermined centerline-to-centerline distance between said apertures;

a gasket;

and said tube end connector rim portions including a gasket groove for supporting said gasket;

each of said rim portions having a shoulder portion opposite from said gasket groove; and said heat exchanger further including a clamp member surrounding said tube end connector and engaging said shoulder portion, and fastening means connecting said clamp member to said associated tube sheet for drawing said tube end connector toward said associated tube sheet.

2. A heat exchanger comprising:

an elongated shell surrounding an axial cavity with said elongated shell having first and second ends;

a plurality of tubes contained within said axial cavity with each of said tubes having first and second tube ends;

first and second tube sheets connected to said elongated shell at said first and second ends, respectively, and each having a plurality of apertures of predetermined diameter therethrough for receiving said first and second tube ends spaced apart at a predetermined centerline-to-centerline distance; and a plurality of substantially U-shaped tube end connectors each having a U-shaped portion and a rim portion connected to said U-shaped portion and surrounding an opening to a chamber defined within said U-shaped portion, wherein each of said tube end connectors is demountably fastened to an associated tube sheet with said opening facing and overlapping two of said apertures and having a width approximately equal to said predetermined diameter of said apertures and a length approximately equal to said predetermined diameter of said apertures plus said predetermined centerline-to-centerline distance between said apertures;

each of said tube end connectors has a substantially U-shaped cross section in a first plane bisecting said tube end connector, and a substantially U-shaped cross section in a second plane perpendicular to said first plane and also bisecting said tube end connector;

a gasket;

each of said tube end connector rim portions including a gasket groove for supporting said gasket; and each of said rim portions having a shoulder portion opposite from said gasket groove; and said heat exchanger further including a clamping member surrounding said tube end connector and engaging said shoulder portion; and fastening means connecting said clamping member to said associated tube sheet for drawing said tube end connector towards said associated tube sheet.

* * * * *